US006638199B2

(12) United States Patent
Annesi et al.

(10) Patent No.: US 6,638,199 B2
(45) Date of Patent: Oct. 28, 2003

(54) COLLAPSIBLE STRUCTURE DEVICE FOR PRACTICING ELASTICS-ASSISTED TRAMPOLINE, AN ACTIVITY CALLED "ACRO-BUNGY"

(76) Inventors: Bruno Annesi, 7, Rue du Mal Pas, 34230 Le Pouget (FR); Pascal Michel, 1 Bis, Impasse de Metz, 34070 Montpellier (FR)

( * ) Notice: Subject to any disclaimer, the term of this patent is extended or adjusted under 35 U.S.C. 154(b) by 0 days.

(21) Appl. No.: 09/929,512

(22) Filed: Aug. 13, 2001

(65) Prior Publication Data

US 2002/0111250 A1 Aug. 15, 2002

(30) Foreign Application Priority Data

Feb. 9, 2001 (FR) ..... 01 01783

(51) Int. Cl.[7] ..... A63B 5/11
(52) U.S. Cl. ..... 482/27
(58) Field of Search ..... 482/27–29; 135/98, 135/97, 128, 120.4, 120.3, 20.3, 20.1, 21

(56) References Cited

U.S. PATENT DOCUMENTS 985,243 A * 2/1911 Bahan ..... 135/98
1,520,719 A * 12/1924 Pilkinton ..... 135/98
RE16,037 E * 3/1925 Berg ..... 135/98
3,213,868 A * 10/1965 Forbes ..... 135/98
4,074,682 A * 2/1978 Yoon ..... 135/135
5,221,241 A * 6/1993 Bare, II ..... 482/43
5,593,368 A * 1/1997 Checketts ..... 482/27
5,740,822 A * 4/1998 Einck ..... 135/16
6,016,822 A * 1/2000 Lin et al. ..... 135/24
6,135,922 A * 10/2000 Nissen ..... 482/27
6,162,061 A * 12/2000 Taylor ..... 434/253

* cited by examiner

*Primary Examiner*—Nicholas D. Lucchesi
*Assistant Examiner*—Fenn C Mathew
(74) *Attorney, Agent, or Firm*—Harrison & Egbert

(57) ABSTRACT

The invention relates to a collapsible structure device for practicing elastics-assisted trampoline, an activity called "acro-bungy".

It includes a central mast (4) along which can vertically move, while being actuated through mechanical means (43), with a possibility of being locked in the upper position, a slide (6) on which are fitted, through their one end (51), legs aimed at being unfolded on both sides of the mast (4), while passing above one or several trampolines, and to which elastics are fixed.

6 Claims, 1 Drawing Sheet

COLLAPSIBLE STRUCTURE DEVICE FOR PRACTICING ELASTICS-ASSISTED TRAMPOLINE, AN ACTIVITY CALLED "ACRO-BUNGY"

BACKGROUND OF THE INVENTION (1) Field of the Invention

This invention relates to a collapsible structure device for practicing elastics-assisted trampoline, an activity called "acro-bungy".

The activity called "acro-bungy" unites the effects of a trampoline with those of being hung from elastics. In practice, the user is connected, through a harness, to two groups of elastics, one on each side, starting obliquely, fixed, in turn, several meters higher, above a trampoline. The trampoline allows performing jumps, whereas the elastics accelerate the upward travel and decelerate the downward travel, thus providing sensations never felt so far.

(2) Description of the Prior Art

Though practicing trampoline has no inherent drawback, the use of the elastics requires, besides fixing points, means allowing adjusting the useful length of said elastics, in order to allow fastening the user and adjusting their tightening.

Practicing such an activity requires a particular structure, since there is no place intended for this purpose, except gymnasiums where the equipment of which can be adapted. The situation is however different when an installation has to be erected in open air or in a room without any equipment.

Furthermore, since the so-called "acro-bungy" activity is essentially intended for being practiced in open air, e.g. on a beach, it is convenient for the structure to be able to be easily mounted and dismantled, if possible by a limited number of persons.

BRIEF SUMMARY OF THE INVENTION

This invention is aimed at providing a collapsible structure device allowing achieving these various objectives.

The collapsible structure device for practicing elastics-assisted trampoline, an activity called "acro-bungy", object of this invention, is mainly characterized in that it includes a central mast along which can vertically move, while being actuated through mechanical means, with a possibility of being locked in the upper position, a slide on which are fitted, through their one end, legs aimed at being unfolded on both sides of said mast, while passing above one or several trampolines, and to which elastics are fixed.

According to an additional feature of the structure device according to the invention, the mechanical means consist of a winch arranged at the foot of the mast, the rope of said winch passing inside said mast, to leave it at the upper end of it where it passes onto a pulley, whereas its end is made integral with the slide.

According to another additional feature of the structure device according to the invention, the slide includes a sleeve aimed at being inserted onto the mast, to which are radially fixed fixing elements for the legs.

According to another additional feature of the structure device according to the invention, the legs are fixed, each, to a fixing element, through means allowing the pivoting about a horizontal axis and a locking when said legs are in a position for use.

The hinged joints allow the legs to be fixed to the slide when the latter is in a lower position and to be put upright during the upward travel of said slide alongside the mast.

According to another particular embodiment of the structure device according to the invention, the fixing elements consist of four tubes made radially integral with the sleeve, forming a cross.

According to an additional feature of the particular embodiment of the structure device according to the invention, the tubes have, each, at their free end, a plate aimed at co-operating with a similar plate each leg includes.

According to another additional feature of the particular embodiment of the structure device according to the invention, the plates of the tubes and the legs are assembled through a pivot with a horizontal axis connecting said plates at their upper edge, while they include holes capable of coinciding, in order to carry out a fixing through bolts.

The advantages and the features of the device according to the invention will clearly appear from the following description, which refers to the attached drawing that shows a non-restrictive embodiment of it.

DETAILED DESCRIPTION OF THE INVENTION

Figure 1:
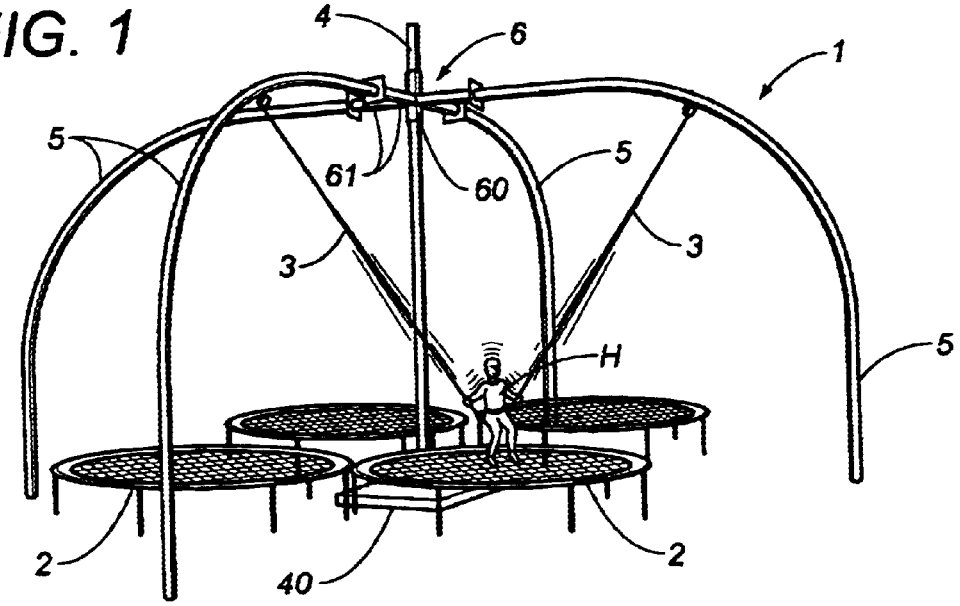
FIG. 1 is a schematic perspective view of an installation for practicing elastics-assisted trampoline, activity called "acro-bungy", including a structure device according to the invention.

With reference to FIG. 1, one can see an installation for practicing elastics-assisted trampoline, activity called "acro-bungy".

This installation includes a structure device 1 according to the invention, as well as trampolines 2. The trampolines 2, four in number, or more, in this embodiment, are placed under the structure device 1 to which are attached the elastics 3.

In practice, the user H locates himself in the center of a trampoline 2 and is equipped with a harness to which are fixed two groups of elastics 3, one group on each side, fixed approximately at the level of the waist, and attached, at their other end, to two points far away from each other, so that they form a kind of V. After tightening the elastics 3, the user H jumps and rebounds on the trampoline 2, the effect of which is associated to that of the trampoline 2 in that they accelerate the upward travel and decelerate the downward travel.

The structure device 1 according to the invention includes a central tubular mast 4 and four arch-shaped legs 5, or more, depending on the number of trampolines, which perpendicularly meet in the vicinity of the top of the mast 4, whereby these legs 5 can be formed of several butt-jointed elements.

Figure 2:
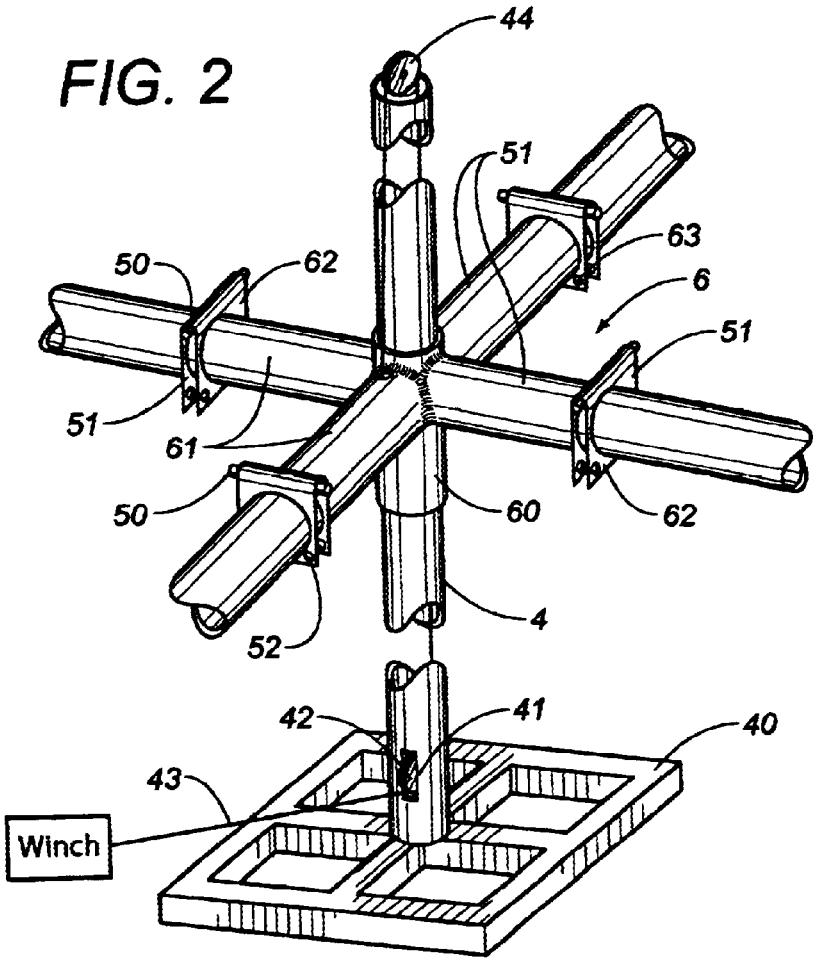
FIG. 2 is a perspective view of part of the same device.

With reference to FIG. 2, one can see that the mast 4 has, at its foot, a square base 40 capable of ensuring some stability of same.

One can also see a slide 6, including a sleeve 60 the size of which allows it to slide on the mast 4 onto which it is inserted, as well as four tubes 61 radially welded to the sleeve 60 and forming a cross.

Each of the tubes 61 is aimed at making integral a leg 5 to which it is hingedly jointed about a horizontal transversal axis, through a pivot 50 connecting two plates 51 and 62, each being integral, one with the end of a leg 5 and the other with a tube 61. One should note that the pivots 50 are arranged horizontally and in the upper portion of the plates 51 and 62, the lower portion including holes 52 and 63, respectively, for a fixing by bolts.

Furthermore, the mast 4 includes, in the vicinity of the base 40, a slot 41 allowing accommodating a return pulley 42 on which passes a cable 43 running through the mast 4 and leaving it at the upper end of the latter where it passes onto a second return pulley 44, before being fixed to the slide 6, whereas its other end is wound about a winch, not shown.

One will understand that through actuating the winch, i.e. winding up or unwinding the cable 43, the slide 6 is moved alongside the mast 4.

The mounting of the structure device 1 according to the invention is thus carried out as follows: the mast 4 is laid down, in order to allow inserting on it the sleeve 60 of the slide 6, then it is put upright. The next step consists in hoisting the slide 6 to the top of the mast 4, by means of the winch, then to fix the legs 5 to it.

The structure device according to the invention has the advantage that its mounting, as described above, can be carried out by one single person.

One should note that according to a variant, it is possible, when the slide 6 is positioned close to the foot of the mast 4, to make the legs 5 integral with the tubes 61 or with part of them, when the latter are formed of butt-jointed elements, and more exactly to assemble the plates 51 and 62 to each other only by means of pivots 50, so that the upward travel of the slide 6 results into putting the legs 5 upright, the assembling by bolts of the plates 51 and 62 being carried out once these are completely upright.

What is claimed:

1. A collapsible structure for use with elastics-assisted trampoline activities comprising:

a base;

a central mast extending vertically upwardly from said base;

a slide slidably mounted on said central mast;

a mechanical means for moving said slide vertically along said central mast, said mechanical means comprising:

a winch positioned at a foot of said central mast, said mechanical means for locking said slide in an upper position on said central mast;

a rope extending from said winch and through an interor of said central mast;

a pulley positioned adjacent an upper end of said central mast, said rope extending over said pulley, said rope having an end opposite said winch affixed to said slide;

a plurality of legs respectively affixed at one end thereof to said slide, said plurality of legs being unfoldable on sides of said central mast, said plurality of legs having elastics respectively affixed thereto; and at least one trampoline positioned below said plurality of legs.

2. The collapsible structure of claim 1, said slide comprising a sleeve extending around said central mast, said sleeve having a plurality of fixing elements extending radially therefrom, said plurality of legs being respectively affixed to said plurality of legs.

3. The collapsible structure of claim 2, said slide further comprising pivoting means connected respectively to said plurality of legs and to said plurality of fixing elements, said pivoting means for allowing said plurality of legs to pivot about a horizontal axis and for locking said plurality of legs in an outwardly extended position.

4. The collapsible structure of claim 2, said plurality of fixing elements comprising four tubes extending radially from said sleeve in a cross pattern.

5. The collapsible structure of claim 4, each of said four tubes having a plate of an end thereof, each of said plurality of legs having a plate at an end thereof cooperative with the plate of said four tubes.

6. The collapsible structure of claim 5, each of the plates of said plurality of legs and said four tubes having a pivot joining an upper edge of the plate of the leg to an upper edge of the plate of the tube, said pivot having a horizontal axis, each of the plates having a hole suitable for receiving a through bolt therein.

* * * * *